US009745990B2

(12) United States Patent
Lu et al.

(10) Patent No.: US 9,745,990 B2
(45) Date of Patent: Aug. 29, 2017

(54) FAN FRAME AND ASSEMBLING METHOD THEREOF

(71) Applicant: DELTA ELECTRONICS, INC., Taoyuan Hsien (TW)

(72) Inventors: Chao-Wen Lu, Taoyuan Hsien (TW); Chun-Chih Wang, Taoyuan Hsien (TW); Ding-Wei Chiu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 481 days.

(21) Appl. No.: 14/455,061

(22) Filed: Aug. 8, 2014

(65) Prior Publication Data

US 2015/0300370 A1 Oct. 22, 2015

(30) Foreign Application Priority Data

Apr. 18, 2014 (CN) ..... 2014 1 0158754

(51) Int. Cl.
*F04D 29/42* (2006.01)
*F04D 29/02* (2006.01)
*F04D 29/62* (2006.01)

(52) U.S. Cl.
CPC ..... *F04D 29/023* (2013.01); *F04D 29/4226* (2013.01); *F04D 29/626* (2013.01); *F05D 2230/53* (2013.01); *F05D 2300/10* (2013.01); *F05D 2300/43* (2013.01)

(58) Field of Classification Search
CPC ..... F04D 29/023; F04D 29/42; F04D 29/624; F04D 29/626; F04D 29/4226; F04D 17/16; H05K 7/20172; H05D 2230/53; F05D 2300/10; F05D 2300/43
See application file for complete search history.

(56) References Cited

U.S. PATENT DOCUMENTS 5,158,432 A * 10/1992 Cox ..... B21D 39/03 29/513
5,199,903 A * 4/1993 Asick ..... H01R 9/032 439/585
8,475,123 B2 * 7/2013 Ai ..... F04D 25/0613 415/200
2010/0028144 A1 * 2/2010 Hung ..... F04D 29/626 415/203
2015/0252680 A1 * 9/2015 LeBlanc ..... F01D 17/162 415/146

* cited by examiner

*Primary Examiner* — Kenneth Bomberg
*Assistant Examiner* — Hoon Choi
(74) *Attorney, Agent, or Firm* — Kirton McConkie; Evan R. Witt

(57) ABSTRACT

A fan frame includes a first frame and a second frame. The first frame includes at least a first sidewall and a first connecting element, wherein the first connecting element is disposed on the first sidewall. The second frame includes at least a second sidewall and a second connecting element, wherein the second connecting element is disposed on the second sidewall and at least partially overlapped with the first connecting element. The second connecting element includes a first end and a second end in a first direction, wherein the first end and the second end are bent toward the first connecting element, respectively, for grasping the first connecting element. As a result, the accuracy error and the precision error are avoided, the stresses are internally counterbalanced, and the deformation of the fan frame is avoided.

11 Claims, 4 Drawing Sheets

FAN FRAME AND ASSEMBLING METHOD THEREOF

FIELD OF THE INVENTION

The present invention relates to a frame, and more particularly to a fan frame and an assembling method thereof.

BACKGROUND OF THE INVENTION

Generally, a frame of a blower (i.e. a fan frame) can be separated into two pieces. In other words, a fan frame is detachably assembled by an upper housing and a lower housing. The upper housing and the lower housing are jointed by screw-locking junction, plastic-melting junction, mechanism-snapping junction, cylinder-riveting junction or flange-riveting junction. Although the junction can be implemented by the above-mentioned methods, an accuracy error while matching, an alignment error while assembling, residual stresses while forcing are possibly occurred, thereby forming gap or deforming the product of the fan. In particular, the fan may be broken.

SUMMARY OF THE INVENTION

The present invention provides a fan frame and an assembling method thereof in order to overcome the above-mentioned drawbacks encountered by the prior arts.

The present invention provides a fan frame and an assembling method thereof. By bending the second connecting element to grasp the first connecting element, the accuracy error and the precision error are avoided. Meanwhile, since the second connecting element is bent toward the first connecting element, the stresses are internally counterbalanced such that the deformation of the fan frame is avoided.

In accordance with an aspect of the present invention, a fan frame is provided. The fan frame includes a first frame and a second frame. The first frame includes at least a first sidewall and a first connecting element, wherein the first connecting element is disposed on the first sidewall. The second frame includes at least a second sidewall and a second connecting element, wherein the second connecting element is disposed on the second sidewall and at least partially overlapped with the first connecting element. The second connecting element includes a first end and a second end in a first direction, wherein the first end and the second end are bent twice toward the first connecting element for grasping the first connecting element.

In accordance with another aspect of the present invention, an assembling method of a fan frame is provided. The assembling method includes the steps of providing a first frame and a second frame, disposing a first connecting element and a second connecting element on a first sidewall of the first frame and a second sidewall of the second frame, respectively, at least partially overlapping the second connecting element and the first connecting element, and bending a first end and a second end of the second connecting element twice toward the first connecting element for grasping the first connecting element.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
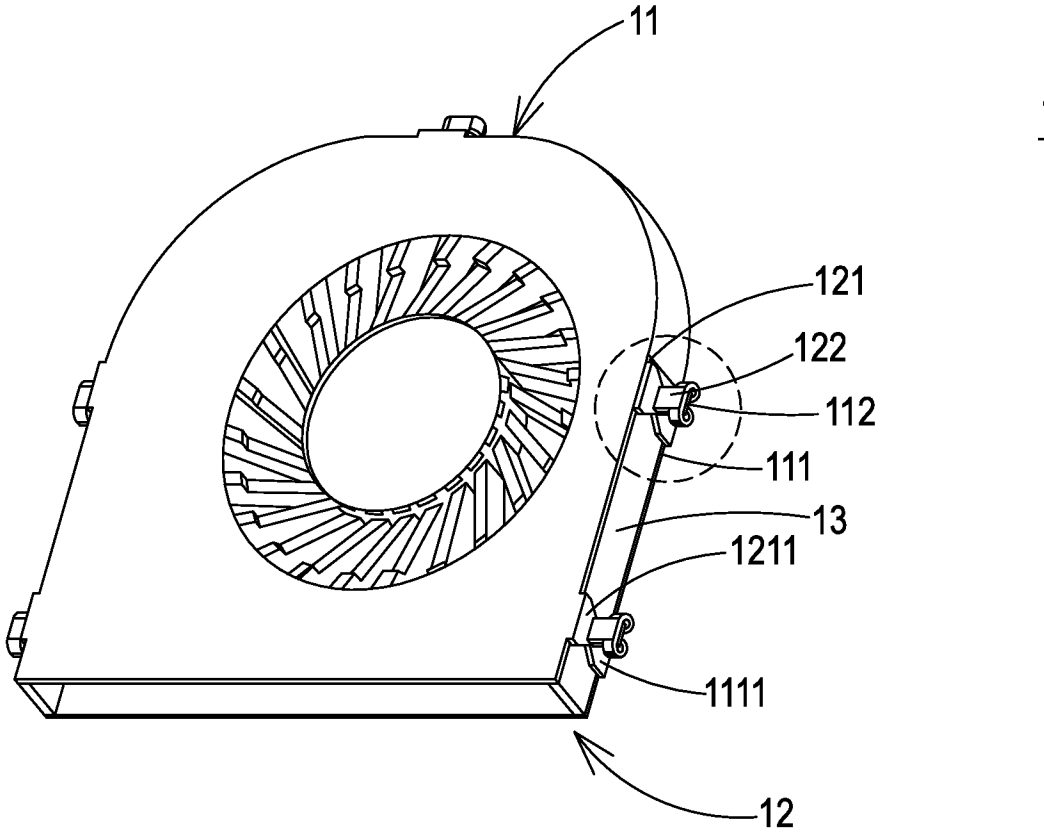
FIG. 1 illustrates the structure of a fan frame according to an embodiment of the present invention.
Figure 2A:
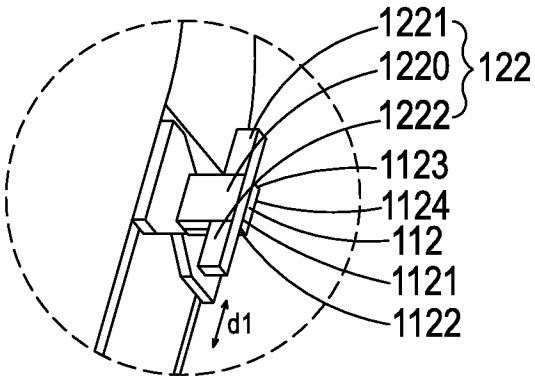
FIG. 2A illustrates the detailed structure of the first end and the second end of the second connecting element before bending.
Figure 2B:
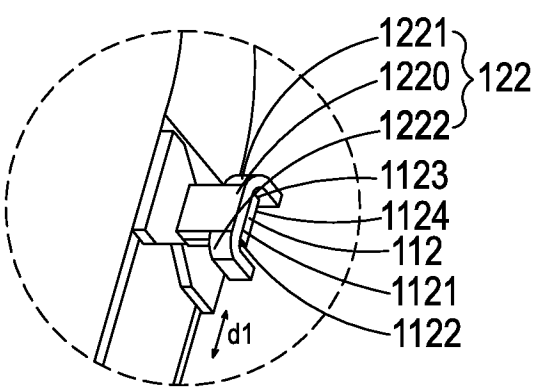
FIG. 2B illustrates the detailed structure of the first end and the second end of the second connecting element after first bending.
Figure 2C:
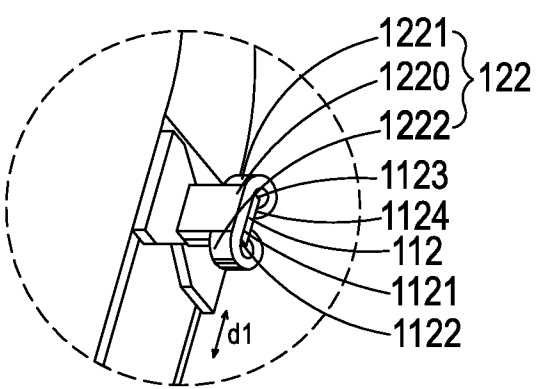
FIG. 2C illustrates the detailed structure of the first end and the second end of the second connecting element after second bending.

FIG. 1 illustrates the structure of a fan frame according to an embodiment of the present invention. FIG. 2A illustrates the detailed structure of the first end and the second end of the second connecting element before bending. FIG. 2B illustrates the detailed structure of the first end and the second end of the second connecting element after first bending. FIG. 2C illustrates the detailed structure of the first end and the second end of the second connecting element after second bending. As shown in FIG. 1, FIG. 2A, FIG. 2B and FIG. 2C, the fan frame 1 of the present invention includes a first frame 11 and a second frame 12. The first frame 11 and the second frame 12 are preferably the upper cover and the base of the fan frame 1, but not limited thereto. The first frame 11 includes at least a first sidewall 111 and a first connecting element 112. The first connecting element 112 is disposed on the first sidewall 111 and exposed outside the first frame 11. The second frame 12 includes at least a second sidewall 121 and a second connecting element 122. The second connecting element is disposed on the second sidewall 121, exposed outside the second frame 12, and at least partially overlapped with the first connecting element 112. The second connecting element 122 includes a first end 1221 and a second end 1222 in a first direction d1. The first end 1221 and the second end 1222 are bent twice toward the first connecting element 112 for grasping the first connecting element 112 (as shown in FIG. 2C). Moreover, the fan frame 1 further includes a frame sidewall 13. The frame sidewall 13 is disposed and assembled between the first frame 11 and the second frame 12. The frame sidewall 13 is made of plastic or metal and assembled with the first frame 11 and the second frame 12. Preferably, the frame sidewall 13, the first frame 11 and the second frame 12 are integrally formed as a single piece.

In some embodiments, the second connecting element 122 includes a connect portion 1220 connected with the first end 1221 and the second end 122 and at least partially overlapped with a first surface 1121 of the first connecting element 112. Additionally, the first connecting element 112 includes a second surface 1122, a third surface 1123 and a fourth surface 1124. The second surface 1122 and the third surface 1123 are parallel with each other and respectively connected with the first surface 1121, the first end 1221 and the second end 1222 are bent toward the second surface 1122 and the third surface 1123 while first bending, and the second surface 1122 and the third surface 1123 are at least partially covered by the first end 1221 and the second end 1222, respectively (as shown in FIG. 2B). The fourth surface 1124 of the first connecting element 112 is parallel with the first surface 1121 and connected with the second surface 1122 and the third surface 1123. The first end 1221 and the second end 1222 are bent while second bending for at least partially covering the fourth surface 1124 (as shown in FIG. 2C), but not limited thereto. Under this circumstance, the first connecting element 112 is completely grasped by the second connecting element 122 by multi-surface and multi-direction so that the first connecting element 112 and the second connecting element 122 are six-directionally fixed (i.e. fixed in the positive direction and the negative direction of three-dimension), and further the first frame 11 and the second frame 12 are also six-directionally fixed. The friction force is enhanced and the deformation is avoided.

In addition, the first connecting element 112 is not limited to an I-shaped connecting element, and the second connecting element 122 is not limited to a T-shaped connecting element. Based on the structural features mentioned above, when a gap between the first connecting element 112 and the second connecting element 122 is formed due to the manufacturing error while pressing and bending the first end 1221 and the second end 1222, the stresses given by the fixture can be almost internally counterbalanced. Therefore, the deformation of the fan frame 1 during assembling is avoided.

Moreover, the first connecting element 112 is made of a metallic or plastic material, but not limited thereto. The second connecting element 122 is made of a metallic material that is beneficial to bend, crimp and grasp the first connecting element 112. It should be noted that if any other material can be bent in above-mentioned manners or applied to the assembling method of the fan frame of the present invention because of technology evolution, they are all taught by the present invention.

In some embodiments, the first sidewall 111 of the first frame 11 and the second sidewall 121 of the second frame 12 include at least a first extending portion 1111 and at least a second extending portion 1211, respectively. The first connecting element 112 and the second connecting element 122 are disposed on the first extending portion 1111 and the second extending portion 1211, respectively. By the shape features of the first connecting element 112 and the second connecting element 122, or the extended path caused by the coordination of the first extending portion 1111 and the second extending portion 1211, the deformation of the fan frame 1 during assembling is effectively absorbed, and further the accuracy error and the alignment error are avoided.

Figure 3:
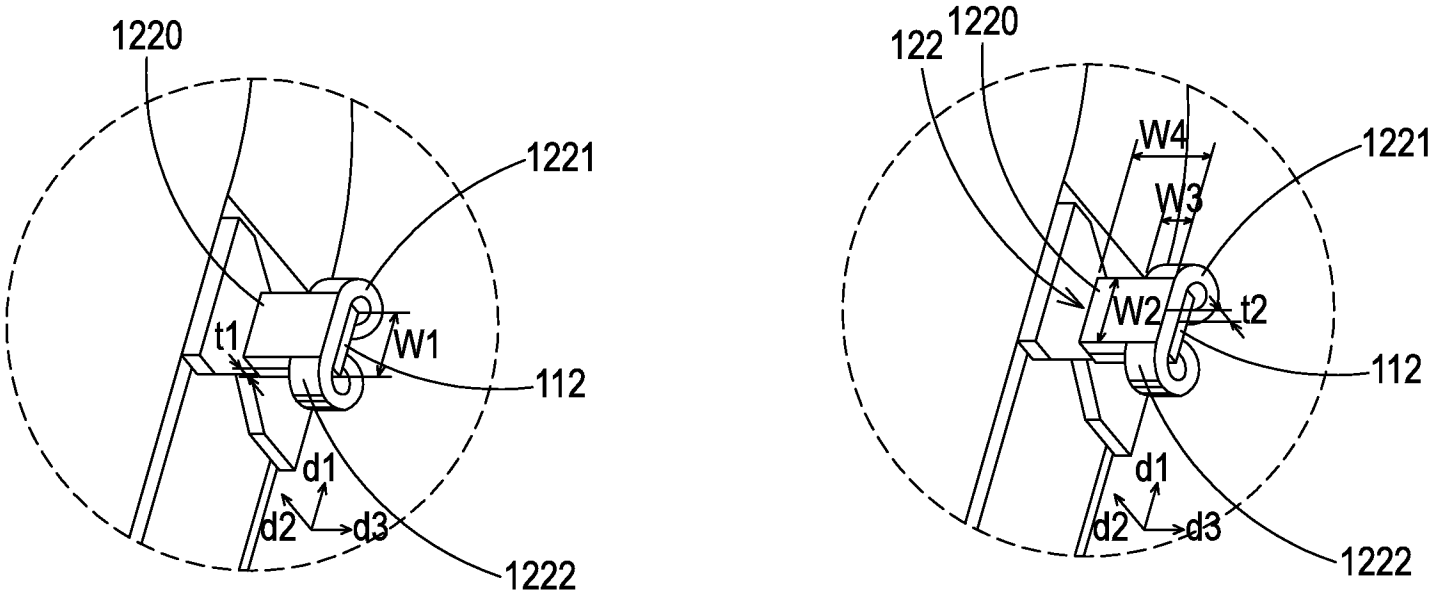
FIG. 3 illustrates the proportion of the widths and the thicknesses of the first connecting element and the second connecting element.

Please refer to FIG. 2C and FIG. 3. FIG. 3 illustrates the proportion of the widths and the thicknesses of the first connecting element and the second connecting element. As shown in FIG. 2C and FIG. 3, the first connecting element 112 of the first frame 11 has a first width W1 in the first direction d1 and a first thickness t1 in a second direction d2, wherein the first width W1 is greater than or equal to two times of the first thickness t1 and is less than or equal to twelve times of the first thickness t1, that is, $2t1 \leq W1 \leq 12t1$.

On the other hand, the connect portion 1220 of the second connecting element 122 of the second frame 12 has at least a second width W2 in the first direction d1 and a second thickness t2 in the second direction d2, wherein the second width W2 is greater than or equal to two times of the second thickness t2 and is less than or equal to ten times of the second thickness t2, that is, $2t2 \leq W2 \leq 10t2$. It should be noted that the second width W2 described in this embodiment represent the minimum of the width of the connect portion 1220 in the first direction d1 along the second direction d2. That is, when the connect portion 1220 is not designed so as to be equal-width, the second width W2 is the narrowest width of the connect portion 1220 in the first direction d1 along the second direction d2, which is the minimum width of the connect portion 1220 along the second direction d2.

Additionally, each of the first end 1221 and the second end 1222 of the second connecting element 122 has a third width W3 in a third direction d3, wherein the third width W3 is greater than or equal to two times of the second thickness t2 and is less than or equal to nine times of the second thickness t2, that is, $2t2 \leq W3 \leq 9t2$. Meanwhile, the connect portion 1220 of the second connecting element 122 has a fourth width W4 in the third direction d4, wherein the difference between the fourth width W4 and the third width W3 is greater than or equal to two times of the second thickness t2 and is less than or equal to ten times of the second thickness t2, that is, $2t2 \leq W4-W3 \leq 10t2$.

Through the proportional relation between the widths and the thicknesses, the influence of the main structure of the fan frame 1 of the present invention is effectively avoided during assembling. Moreover, the first direction d1, the second direction d2 and the third direction d3, which are mentioned above, are perpendicular to each other.

Figure 4:
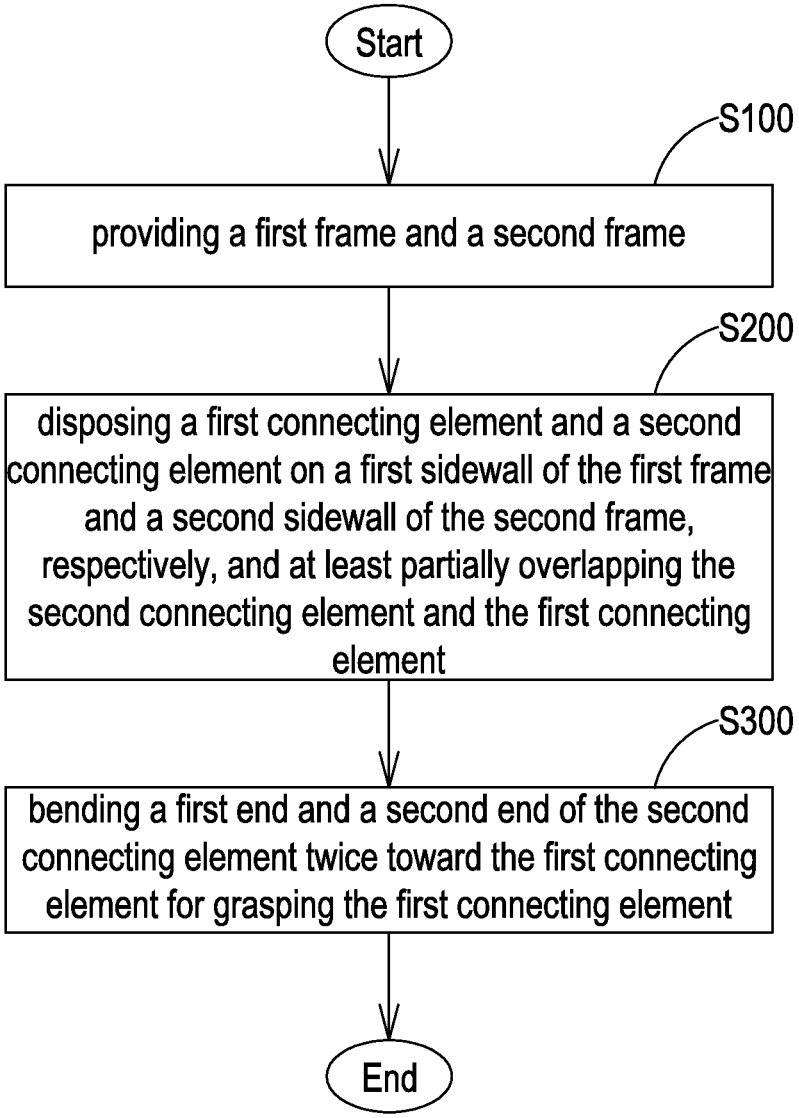
FIG. 4 illustrates the flow chart of an assembling method of a fan frame according to an embodiment of the present invention.

FIG. 4 illustrates the flow chart of an assembling method of a fan frame according to an embodiment of the present invention. As shown in FIG. 1, FIG. 2A, FIG. 2B, FIG. 2C and FIG. 4, an assembling method of the fan frame 1 according to an embodiment of the present invention includes the steps as follows. First, a first frame 11 and a second frame 12 are provided at step S100. Then, at step S200, a first connecting element 112 and a second connecting element 122 are disposed on a first sidewall 111 of the first frame 11 and a second sidewall 121 of the second frame 12, respectively, and the second connecting element 122 and the first connecting element 112 are partially overlapped. Next, a first end 1221 and a second end 1222 of the second connecting element 122 are bent twice toward the first connecting element 112 for grasping the first connecting element 112 at step S300.

From the above descriptions, the present invention provides a fan frame and an assembling method thereof. By bending the second connecting element to grasp the first connecting element, the accuracy error and the precision error are avoided. Meanwhile, since the second connecting element is bent toward the first connecting element, the stresses are internally counterbalanced, such that the deformation of the fan frame is avoided.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan frame comprising:

a first frame comprising at least a first sidewall and a first connecting element disposed on the first sidewall;

a second frame comprising at least a second sidewall and a second connecting element disposed on the second sidewall and at least partially overlapped with the first connecting element, wherein the second connecting element has a first end and a second end in a first direction, and the first end and the second end are bent toward the first connecting element, respectively, for grasping the first connecting element; and a frame sidewall disposed and assembled between the first frame and the second frame.

2. The fan frame according to claim 1, wherein the second connecting element comprises a connect portion connected with the first end and the second end and at least partially overlapped with a first surface of the first connecting element.

3. The fan frame according to claim 2, wherein the first connecting element comprises a second surface and a third surface, wherein the second surface and the third surface are parallel with each other and respectively connected with the first surface, the first end and the second end are bent toward the second surface and the third surface, and the second surface and the third surface are at least partially covered by the first end and the second end, respectively.

4. The fan frame according to claim 3, wherein the first connecting element includes a fourth surface parallel with the first surface and connected with the second surface and the third surface, and the first end and the second end are bent for at least partially covering the fourth surface.

5. The fan frame according to claim 2, wherein the first connecting element has a first width in the first direction and a first thickness in a second direction, and the first width is greater than or equal to two times of the first thickness and is less than or equal to twelve times of the first thickness.

6. The fan frame according to claim 5, wherein the connect portion of the second connecting element has at least a second width in the first direction and a second thickness in the second direction, and the second width is greater than or equal to two times of the second thickness and is less than or equal to ten times of the second thickness.

7. The fan frame according to claim 6, wherein each of the first end and the second end of the second connecting element has a third width in a third direction, and the third width is greater than or equal to two times of the second thickness and is less than or equal to nine times of the second thickness.

8. The fan frame according to claim 7, wherein the connect portion of the second connecting element has a fourth width in the third direction, and the difference between the fourth width and the third width is greater than or equal to two times of the second thickness and is less than or equal to ten times of the second thickness.

9. The fan frame according to claim 1, wherein the first sidewall and the second sidewall include at least a first extending portion and at least a second extending portion, respectively, and the first connecting element and the second connecting element are disposed on the first extending portion and the second extending portion, respectively.

10. The fan frame according to claim 1, wherein the frame sidewall is made of plastic or metal, and assembled with the first frame and the second frame, or the frame sidewall, the first frame and the second frame are integrally formed as a single piece.

11. An assembling method of a fan frame, comprising steps of:

providing a first frame, a second frame, and a frame sidewall, wherein the frame sidewall is disposed and assembled between the first frame and the second frame;

disposing a first connecting element and a second connecting element on a first sidewall of the first frame and a second sidewall of the second frame, respectively, and at least partially overlapping the second connecting element and the first connecting element; and bending a first end and a second end of the second connecting element toward the first connecting element for grasping the first connecting element.

* * * * *